US005081803A

United States Patent [19]

Jackson

[11] Patent Number: 5,081,803

[45] Date of Patent: Jan. 21, 1992

[54] PIT AREA FOR A RACE TRACK

[76] Inventor: Terrill E. Jackson, P.O. Box 1385, Cartersville, Ga. 30120

[21] Appl. No.: 636,504

[22] Filed: Dec. 31, 1990

[51] Int. Cl.[5] ..... E01C 1/00; C04H 6/00

[52] U.S. Cl. ..... 52/33; 52/169.2; 52/174

[58] Field of Search ..... 52/169.1, 169.2, 174, 52/175, 33, 234; 272/4; 404/6, 7; 414/227, 228

[56] References Cited

U.S. PATENT DOCUMENTS 1,472,793 6/1921 Fitch ..... 52/175
1,481,939 1/1924 Tucker ..... 52/175

OTHER PUBLICATIONS

Autocar & Motor, 1/2/91.

Road & Track, 12/1990.

*Primary Examiner*—David A. Scherbel
*Assistant Examiner*—Robert J. Canfield
*Attorney, Agent, or Firm*—John L. James

[57] ABSTRACT

A pit area for a race track a stall has first and second sidewalls. A first end wall is adjacent a selected one of the first and second sidewalls and extends toward the other of the first and second sidewalls defining an entrance to the stall. A second end wall is adjacent a selected one of said first and second sidewalls and extends toward the other of said first and second sidewalls defining an exit from the stall. An entrance driveway is adjacent the stall with the stall being at an angle to the entrance driveway. An exit driveway is adjacent the stall with the stall being at an angle to the exit driveway.

13 Claims, 2 Drawing Sheets

PIT AREA FOR A RACE TRACK

TECHNICAL FIELD

This invention generally relates to a race track, and, more particularly, to a pit area of a race track wherein racing cars are brought for servicing during the course of a race.

BACKGROUND OF THE INVENTION

Automobile racing is a sport enjoyed by millions of people. To accommodate the fans present during a race, race tracks include spectator stands positioned about the perimeter of the race track. Because the spectator stands occupy the outside of the track, the pit area is usually located on the inside of the track. Cars requiring service during a race pull off the track into the pit area, and when servicing is completed, return to the track.

The pit area is usually a busy and crowded place with racing cars pulling in and out, and work crews busy changing tires and attending to the race cars. Emergency vehicles may also be present in the pit area. Because many racing events are televised, radio and television crews may also be present in or about the pit area before, during and after a race, making the pit area a crowded area. Unfortunately, there is a danger that cars pulling in or out of the pit area may strike one of the people present.

While pit crew members are usually attentive to the cars and safety conscious, other people present may not be as cautious. Regrettably, each year many people are injured in the pit area of race tracks. A number of people have even been killed. Accordingly, it will be appreciated that it would be highly desirable to have a pit area that reduces the risk of injury to a person in the pit area caused by racing cars entering and leaving the pit area.

Because the number of racers is limited, the racers are known and there is a familiarity among racing crews. Even though racing is a competitive sport, it is not unusual for one crew to borrow tools or supplies from another crew during a race. When a crew member desires to borrow a tool, he walks to a neighboring crew. This travelling between crews exposes the crew member to the other racing vehicles thereby increasing the possibility of injury. Accordingly, it will be appreciated that it would be highly desirable to have a pit area wherein a crew member can move about without increasing his risk of injury from the racing cars in the pit area.

During the course of a race, racing drivers and crew members may require medical attention. Medical personnel are usually present in the pit area and move about to deliver medical services which exposes them to the racing vehicles. It is desirable to have a pit area wherein medical personnel can move about without being exposed to injury from the racing vehicles.

SUMMARY OF THE INVENTION

The present invention is directed to overcoming one or more of the problems set forth above. Briefly summarized, according to one aspect of the present invention, a pit area for a race track a stall has first and second sidewalls. A first end wall is adjacent a selected one of the first and second sidewalls and extends toward the other of the first and second sidewalls defining an entrance to the stall. A second end wall is adjacent a selected one of the first and second sidewalls and extends toward the other of the first and second sidewalls defining an exit from the stall. An entrance driveway is adjacent the stall with the stall being at an angle to the entrance driveway. An exit driveway is adjacent the stall with the stall being at an angle to the exit driveway.

Having the stalls at an angle to the entrance and exit driveways reduces the risk of injury to a person in the pit area caused by racing cars entering and leaving the pit area. Crew members and medical personnel can move between stalls without increasing the risk of injury from the racing cars in the pit area by using the walkway. The walkway can be used by reporters in the pit area.

It is an object of the present invention to provide a pit area that reduces the risk of injury to a person in the pit area caused by racing cars entering and leaving the pit area. This object is achieved by providing stalls oriented at an angle to the driveways.

Another object of the invention is to provide a pit area wherein a crew member can move about without increasing his risk of injury from the racing cars in the pit area. This object is achieved by a walkway. The walkway can be above the stalls with a ramp extending down into the stalls.

Another object of the invention is to provide a pit area wherein medical personnel can move about without being exposed to the racing vehicles. The walkway is used by reporters and medical personnel to move about without interfering with the cars in the pit area.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
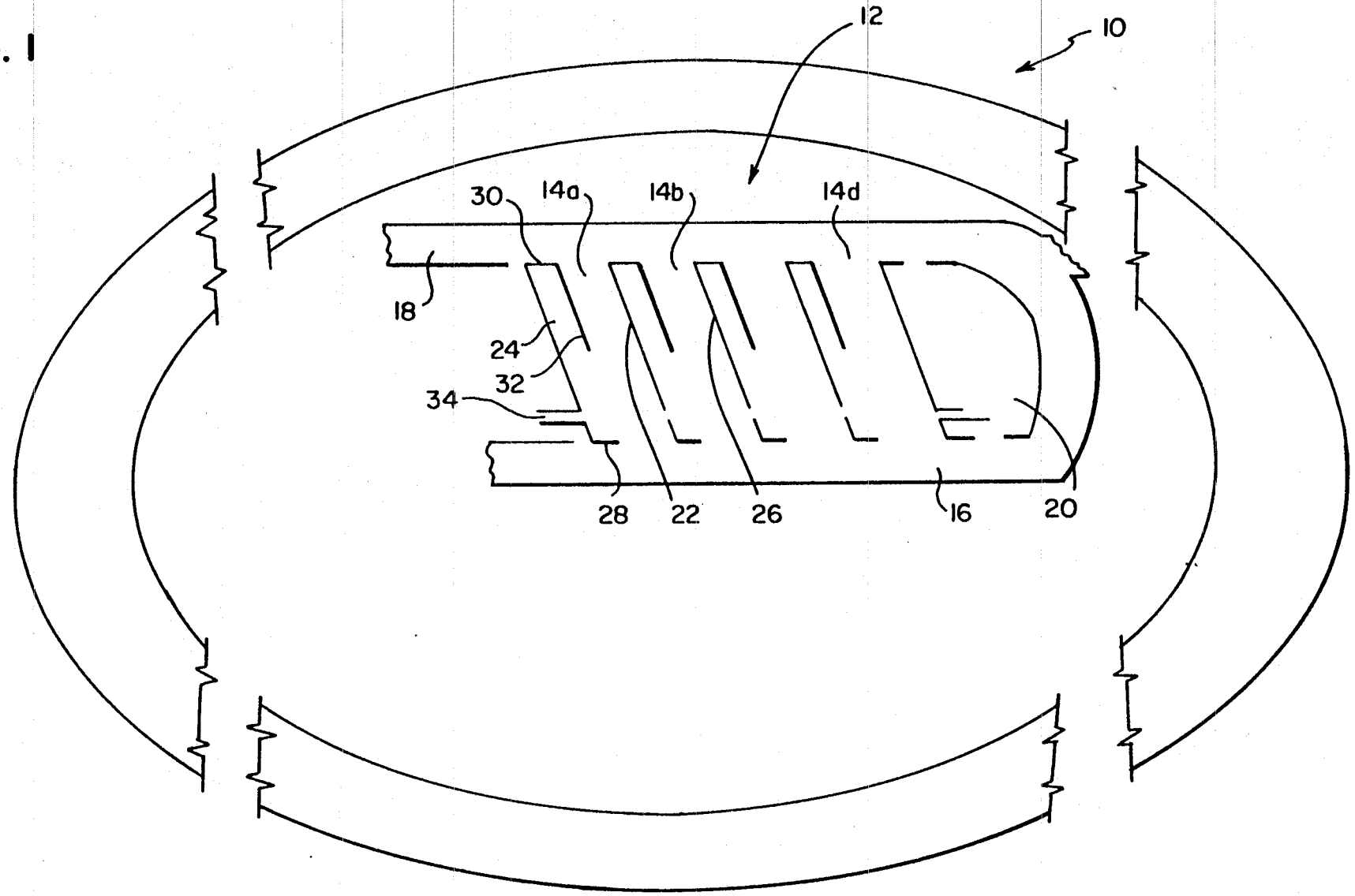
FIG. 1 is a diagrammatic top view of a preferred embodiment of race track incorporating a pit area with stalls constructed in accordance with the present invention.

Referring to the drawings in which like numerals indicate like elements throughout the several figures, FIG. 1, illustrates a race track 10 that is oval in configuration. Spectator stands can be placed around the outside of the oval to accommodate racing fans who wish to view the race in person. The pit area 12 is located on the interior of the oval race track 10. The pit area 12 has a plurality of stalls 14*a–d*. Access to the stalls 14 is provided by an entrance driveway 16, and egress from the stalls 14 is provided by an exit driveway 18. Drivers desiring to leave the race track 10 to enter the pit area 12 use a deceleration lane and the entrance driveway 16 which is accessible from the inner or deceleration lane of the race track 10 to enter the pit area 12.

When servicing is complete, the driver returns to the race track 10 via the exit driveway 18 which returns the driver to the inside or acceleration lane of the track 10. The stalls 14 are oriented at an angle to the driveways 16, 18 to facilitate entering exiting the stalls 14. A driver pulls into a stall 14 from the entrance driveway 16 at a slanted angle similar to pulling into a parking space. This is in contrast to prior pit areas wherein the driver pulled into an area that was aligned with the other areas similar to parallel parking spaces. The stalls 14 are similarly angularly oriented relative to the exit driveway 18. The pit area 12 also contains an area 20 that is used for standby emergency vehicles.

There are a plurality of stalls 14*a–d* arranged side by side. Stalls 14*a* and 14*b* share a common sidewall 22 with stall 14*a* having an exterior sidewall 24 and stall 14*b* having another sidewall 26. Each of the stalls 14*a–d* has the same structure. Stall 14*a* will be described to illustrate the present invention.

The stall 14*a*, in addition to having sidewalls 22, 24, may also have end walls 28, 30. The entrance end wall 28 extends from the exterior sidewall 24 towards the common sidewall 22 leaving a space for the entrance of a racing car from the entrance driveway 16. At the opposite end of the stall 14*a*, there is an exit end wall 30 extending from the exterior sidewall 24 towards the common sidewall 22 leaving a space for the exit of a racing car via the exit driveway 18. The sidewalls 22, 24 and end walls 28, 30 are preferably constructed of concrete to provide an effective barrier between stalls, and to provide a protected work area within the sidewalls 22, 24 and end walls 28, 30. The barrier function may be provided beams or posts and guard rails, as is done highways, instead of using concrete.

The stall 14*a* may also include a divider wall 32 adjacent the entrance end wall 28 and extending a distance into the stall 14*a* toward the exit end wall 30 parallel to the sidewalls 22, 24. The divider wall 32 may also be constructed of concrete or other material. The divider wall 32 divides the stall 14*a* into two compartments with one compartment available for receiving a racing car, and the other compartment available for storing material and equipment used by the crew members.

Still referring to FIG. 1, the end walls 28, 30 are adjacent the sidewalls 22, 24 and may adjoin one of the sidewalls 22, 24. It is preferred that end wall 28 adjoin sidewall 24. End wall 28 may or may not adjoin sidewall 24. End wall 30 may adjoin sidewall 24 when sidewall 24 is separated by a walkway 34 that provides a walkway between stalls. Alternatively, the pathway 34 may be provided by a separation between the end wall 30 and the sidewall 24. Where end wall 30 and sidewall 24 are adjoined, it is easier to obtain the desired structural integrity.

Figure 2:
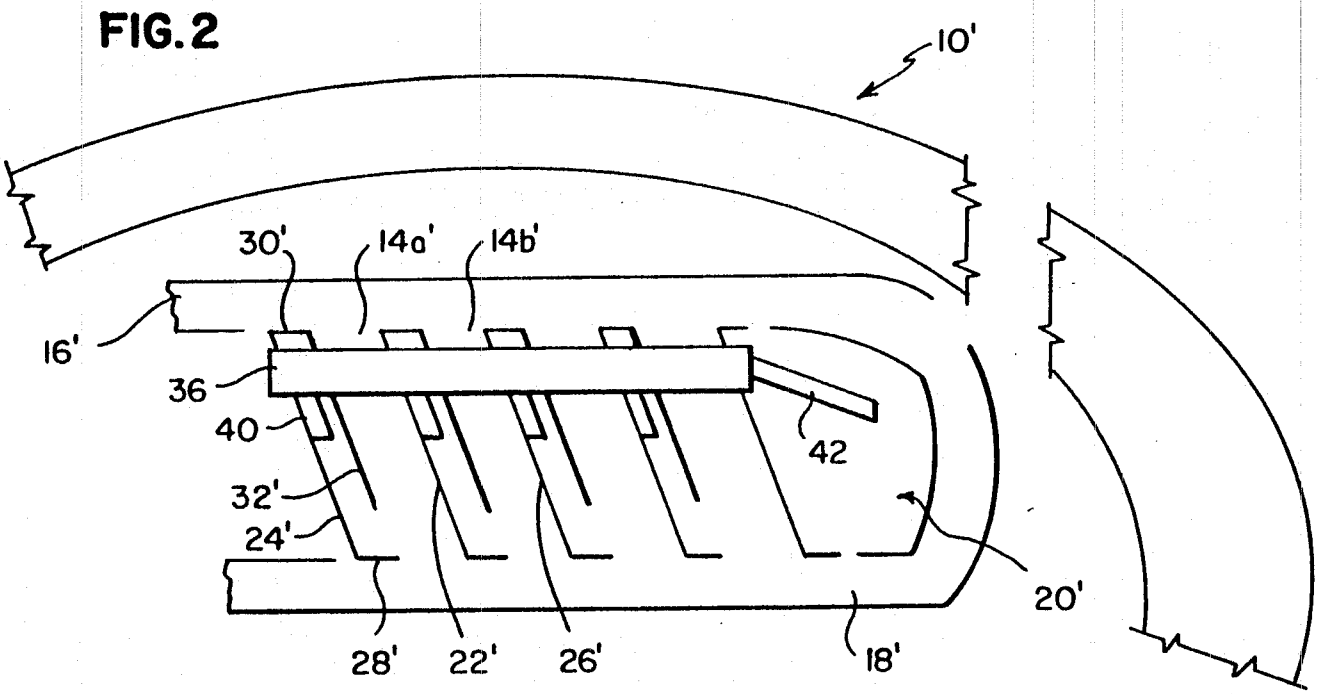
FIG. 2 is a diagrammatic top view of a preferred embodiment of race track incorporating a pit area with stalls constructed in accordance with the present invention similar to FIG. 1, but illustrating another embodiment.
Figure 3:
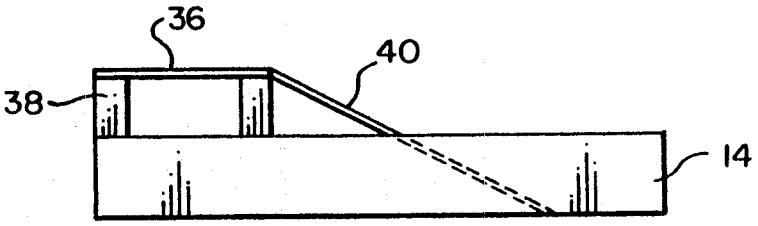
FIG. 3 is diagrammatic left end view of the stalls of FIG. 2.

Referring to FIGS. 2 and 3, another embodiment of a race track 10' that is oval in configuration is illustrated. The pit area 12' is located on the interior of the oval race track 10'. The pit area 12' has a plurality of stalls 14*a–d'*. Access to the stalls 14' is provided by an entrance driveway 16', and egress from the stalls 14' is provided by an exit driveway 18'. Drivers desiring to leave the race track 10' to enter the pit area 12' use a deceleration lane and the entrance driveway 16' which is accessible from the inner or deceleration lane of the race track 10' to enter the pit area 12'.

When servicing is complete, the driver returns to the race track 10' via the exit driveway 18' which returns the driver to the inside or acceleration lane of the track 10'. The stalls 14' are oriented at an angle to the driveways 16', 18' to facilitate entering exiting the stalls 14'. A driver pulls into a stall 14' from the entrance driveway 16' at a slanted angle similar to pulling into a parking space. The stalls 14' are similarly angularly oriented relative to the exit driveway 18'. The pit area 12' also contains an area 20' that is used for standby emergency vehicles.

There are a plurality of stalls 14*a–d'* arranged side by side. Stalls 14*a'* and 14*b'* share a common sidewall 22' with stall 14*a'* having an exterior sidewall 24' and stall 14*b'* having another sidewall 26'. Each of the stalls 14*a–d'* has the same structure. Stall 14*a'* will be described to illustrate the present invention.

The stall 14*a'*, in addition to having sidewalls 22', 24', may also have end walls 28', 30'. The entrance end wall 28' extends from the exterior sidewall 24' towards the common sidewall 22' leaving a space for the entrance of a racing car from the entrance driveway 16'. At the opposite end of the stall 14*a'*, there is an exit end wall 30' extending from the exterior sidewall 24' towards the common sidewall 22' leaving a space for the exit of a racing car via the exit driveway 18'.

The stall 14*a'* may also include a divider wall 32' adjacent the entrance end wall 28' and extending a distance into the stall 14*a* toward the exit end wall 30' parallel to the sidewalls 22', 24'. The divider wall 32' divides the stall 14*a'* into two compartments with one compartment available for receiving a racing car, and the other compartment available for storing material and equipment used by the crew members.

The stalls 14*a–d'* may have a walkway 36 extending above the stalls and supported by posts 38 with stairs or a ramp 40 extending from the walkway 36 into the stalls 14*a–d'*. A ramp 40 is preferred over the stairs to eliminate the possibility of tripping on the stairs. The walkway 36 may cover a portion of the stalls 14*a–d'* or may cover the entire stall area like a canopy. The walkway 36 may be situated over the entrances to the stalls 14*a–d'*, or may be situated over the exits from the stalls 14*a–d'*. A ramp 42 extends from one end of the walkway 36 to the emergency vehicle area 20' of the track 10'.

While operation of the present invention is believed to be apparent from the foregoing description, a few words will be added for emphasis. A driver desiring service moves to the inside lane of the race track 10 to exit the track 10 via the entrance driveway 16. The driver pulls the car past the entrance end wall 28 to enter the stall 14*a* for service. The pit crew obtain supplies and equipment stored behind the barrier wall 32. If medical attention is needed, the medical personnel enter the stall 14*a* using the walkway 34, or ramp 42 and overhead walkway 36 and ramp 40 to enter the stall 14*a*. Reporters can interview the driver during the race using the walkway to visit the driver during a pit stop. If a crew member needs to borrow a tool from another stall, he uses the walkway to access the other stall. When the pit stop is over, the driver exits using the exit driveway 18 to again enter the track 10.

It will be now appreciated that there has been presented a pit area having stalls oriented at an angle to the driveways to reduce the risk of injury to a person in the pit area caused by racing cars entering and leaving the pit area. A crew member can move between stalls without increasing his risk of injury from the racing cars in the pit area because of a walkway above the stalls and stairs extending between the walkway and stairs. The walkway is also used by reporters and medical personnel to move about without interfering with the cars in the pit area.

While the invention has been described with particular reference to a preferred embodiment, it will be understood by those skilled in the art that various changes may be made and equivalents may be substituted for elements of the preferred embodiment without departing from invention. For example, the entire structure could be constructed of concrete, or posts and guard rails, or a combination of these. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, the entrance end wall could accommodate a support for a sign which would designate a particular stall for a particular racing car. It is accordingly intended that the claims shall cover all such modifications and applications as do not depart from the true spirit and scope of the invention.

I claim:

1. A pit area for a race track, comprising:

first and second stalls sharing a common interior sidewall and each having an exterior sidewall, each of said stalls having a first end wall adjacent one of said sidewalls extending toward the other of said sidewalls defining an entrance to said stall, and each of said stalls having a second end wall adjacent one of said sidewalls extending toward the other of said sidewalls defining an exit from said stall;

an entrance driveway adjacent said stalls with said stalls being at an angle to said entrance driveway; and an exit driveway adjacent said stalls with said stalls being at an angle to said exit driveway.

2. A pit area for a race track, as set forth in claim 1, wherein within each of said stalls said first and second end walls are adjacent the same sidewall.

3. A pit area for a race track, as set forth in claim 1, wherein each of said stalls includes a barrier wall generally parallel to said sidewalls and adjacent a selected one of said first and second end walls extending toward the other of said entrance and exit end walls a preselected distance.

4. A pit area for a race track, as set forth in claim 1, wherein each of said stalls includes a barrier wall adjacent a selected one of said first and second end walls extending toward the other of said entrance and exit end walls a preselected distance dividing each of said stalls into two compartments.

5. A pit area for a race track, as set forth in claim 1, including a walkway extending atop said stalls.

6. A pit area for a race track, as set forth in claim 1, including a ramp extending between said walkway and said stalls.

7. A pit area for a race track, as set forth in claim 1, wherein said first end wall and said selected one of said first and second sidewalls are adjacent, but not adjoining one another, having a space therebetween defining a walkway.

8. A pit area for a race track, comprising:

a stall having first and second sidewalls, a first end wall adjacent a selected one of said first and second sidewalls extending toward the other of said first and second sidewalls defining an entrance to said stall, and a second end wall adjacent said selected one of said first and second sidewalls extending toward the other of said first and second sidewalls defining an exit from said stall;

an entrance driveway adjacent said stall with said stall being at an angle to said entrance driveway; and an exit driveway adjacent said stall with said stall being at an angle to said exit driveway.

9. A pit area for a race track, as set forth in claim 8, including a barrier wall generally parallel to said sidewalls and adjacent a selected one of said first and second end walls extending toward the other of said entrance and exit end walls a preselected distance.

10. A pit area for a race track, as set forth in claim 8, including a barrier wall adjacent a selected one of said entrance and exit end walls extending toward the other of said first and second end walls a preselected distance dividing said stall into two compartments.

11. A pit area for a race track, as set forth in claim 8, including a walkway extending atop said stall.

12. A pit area for a race track, as set forth in claim 8, including a ramp extending between said walkway and said stall.

13. A pit area for a race track, as set forth in claim 8, wherein said first end wall and said selected one of said first and second sidewalls are adjacent, but not adjoining one another, having a space therebetween defining a walkway.

* * * * *